United States Patent [19]

Asphahani et al.

[11] 4,410,489

[45] Oct. 18, 1983

[54] HIGH CHROMIUM NICKEL BASE ALLOYS

[75] Inventors: Aziz I. Asphahani; William L. Silence, both of Kokomo; Paul E. Manning, Bringhurst, all of Ind.

[73] Assignee: Cabot Corporation, Kokomo, Ind.

[21] Appl. No.: 284,169

[22] Filed: Jul. 17, 1981

[51] Int. Cl.[3] ..... C22C 19/05

[52] U.S. Cl. ..... 420/453; 420/445; 420/448; 420/451; 420/582

[58] Field of Search ..... 75/171, 170, 134 F, 75/122; 148/32

[56] References Cited

U.S. PATENT DOCUMENTS 3,565,611 2/1971 Economy ..... 75/171

*Primary Examiner*—R. Dean

*Attorney, Agent, or Firm*—J. Schuman; J. J. Phillips

[57] ABSTRACT

Disclosed is a nickel-base alloy which provides excellent corrosion resistance to a variety of severe environments, especially hot phosphoric acid. The alloy preferably contains, in weight percent: about 30 chromium, about 4 molybdenum, about 2 tungsten, about 1 Cb/Ta, about 1.5 copper, about 14 iron and the balance nickel plus the impurities and modifying elements usually found in alloy of this class. The alloy is eminently suited for use as articles in chemical processing apparatus in the manufacture and/or containment of phosphoric acid and sulfuric acid.

3 Claims, No Drawings

HIGH CHROMIUM NICKEL BASE ALLOYS

This invention relates to corrosion-resistant nickel-base alloys and, more particularly, to Ni-Cr-Fe alloys containing molybdenum, tungsten and copper which are corrosion resistant in a variety of severe environments especially phosphoric acid.

Nickel-base alloys containing chromium have been used as corrosion resistant articles for many years. For example, U.S. Pat. No. 873,746 granted to Elwood Haynes on Dec. 17, 1907, disclosed a nickel-base alloy containing a total of 30 to 60% chromium, molybdenum, tungsten and/or uranium that is resistant to boiling nitric acid.

For over seventy years since the Haynes disclosure, continuous research and development has been done to find specific nickel base alloys that are resistant to a variety of corrosive media. Certain alloys especially resistant in one type of acid are usually not resistant in another type of acid.

Thus, the research and development goes on to discover "ideal" alloys that more nearly approach resistance to various media of oxidizing and reducing acid environments. This is of particular interest to The Chemical Process Industries, where the move is toward more efficient processes involving high temperatures and concentrations of various corrosive process media. One typical corrosive medium in chemical processing, and perhaps the most severe, is phosphoric Acid ($P_2O_5$).

In general, it is accepted that alloys with high nickel content, i.e. nickel base alloys, exhibit the best corrosion resistance in phosphoric acid media. Some of these nickel base alloys are disclosed in Table I. These alloys are representative of this crowded art and the subtle degree of advancement that each novel alloy represents. A study of the most recent patents in this art reveals that the new alloys generally contain the same basic elements i.e. (Ni-Cr-Mo-Cu) in various amounts and some elements may be in certain proportions to each other.

U.S. Pat. No. 3,203,792 discloses a NiCrMo alloy commercially known as C-276 alloy in Table 1. This alloy is especially resistant to intergranular corrosion, especially after welding.

U.S. Pat. No. 2,777,766 discloses the NiCrFeMo alloy commercially known as Alloy G in Table 1. Alloy G is generally considered the standard in resistance in many acids including hot sulfuric and phosphoric acids. The alloy resists stress corrosion cracking and pitting.

U.S. Pat. No. 3,160,500 discloses a NiCrMoCb alloy commecially known as Alloy 625 in Table 1. This alloy has a good combination of properties at temperatures up to about 1500° F.

Alloy 690, as defined in Table 1, was disclosed as an experimental alloy. The alloy has a high degree of wet corrosion resistance in acid and caustic solutions. U.S. Pat. Nos. 3,573,901 and 3,574,604 describe alloys of this general class.

After much experimentation, it was found that none of these commercial alloys offers adequate resistance to high concentration phosphoric acid at elevated temperatures, i.e., conditions encountered in the production of superphosphoric acid. None of the prior art patents teach how to obtain alloys with high degree of corrosion resistance to phosphoric acid.

It is the principal object of this invention to provide an alloy highly resistant to a variety of acids, especially phosphoric acid.

Other objects will be apparent to those skilled in this art.

These objects and other benefits are provided by the invention of the alloy as defined in Table II. Both molybdenum and tungsten must be in the alloy. Furthermore, it is preferred that molybdenum exceeds tungsten within the ranges Mo:W = 1.5:1 and 4:1.

In superalloys of this class molybdenum and tungsten are generally considered to be equivalents. This is not true in the alloy of this invention. Although the exact mechanism is not completely understood, it is believed that the content of more molybdenum than tungsten effects an unexpected improvement in high chromium nickel base alloy containing critical contents of copper, iron, and columbium and/or tantalum.

Nickel base alloys of this class may be produced by a variety of metallurgical processes—for example: hot-rolled plate sheet, cold rolled sheet, casting, wire for weld overlay and powder metallurgy.

The alloy of this invention may be produced by several well-known methods as practiced in this art. There is no unusual problem in the production of this alloy since the basic elements are well known to those skilled in the art.

The test examples of the alloy of this invention were produced as sheet and plate by conventional melting, casting, forging and rolling methods.

CHROMIUM CONTENT

The need for high chromium content in an alloy to resist phosphoric acid was demonstrated in the test results given in Table III. The compositions for each of the alloys tested are essentially as shown as "typical" alloy. The corrosion rate is given in mils per year (Mpy). The specimens were tested in 46% phosphoric acid at 116° C. These data suggest that the corrosion resistance is directly related to the chromium content and that there is a need for a 30% Cr to provide good resistance to phosphoric acid.

MOLYBDENUM CONTENT

The effect of molybdenum in this class of alloys was demonstrated in the test results given in Table IV. The specimens were tested in 52% phosphoric acid at 149° C. Alloy 690 is molybdenum-free while alloy G-30A contains 4% molybdenum. Alloy G-30A clearly has improved corrosion resistance to phosphoric acid over the molybdenum-free alloy.

TUNGSTEN CONTENT

The criticality of tungsten content was demonstrated in the test results given in Table V. The specimens were tested in 54% phosphoric acid at 149° C. Both alloys had compositions essentially as shown for G-30 alloy in Table II except Alloy G-30A was tungsten free. In this test, both alloys contain about 30% chromium; and 4% molybdenum; however, Alloy G-30, containing an additional 2% tungsten, had a more favorable corrosion resistance to the superphosphoric acid. Molybdenum must always exceed the tungsten content.

Finally, the alloy of this invention, alloy G-30, and alloy G were tested for corrosion resistance in other acid media, specifically in reducing sulfuric acid and in oxidizing sulfuric acid. Data are given in Table VI. Compositions of the alloys were essentially as given in Table I and Table II for alloy G and alloy G-30; respectively.

While the corrosion resistance of alloy G to sulfuric acid is known to be outstanding in this art, the results from Table VI clearly show the advantages of alloy G-30 over alloy G in providing excellent resistance to sulfuric acid media.

In the production of nickel base alloys of this class, impurities from many sources are found in the final product. These so-called "impurities" are not necessarily always harmful and some may actually be beneficial or have an innocuous effect, for example, boron, aluminum, titanium, vanadium, manganese, cobalt, lanthanum and the like.

Some of the "impurities" may be present as residual elements resulting from certain processing steps, or adventitously present in the charge materials: for example, aluminum, vanadium, titanium, manganese, magnesium, calcium and the like.

In actual practice, certain impurity elements are kept within established limits with maximum and/or minimum to obtain uniform cast, wrought or powder products as well known in the art and skill of melting and processing these alloys. Sulfur and phosphorus must be kept at the lowest possible level.

Thus, the alloy of this invention may contain these and other impurities, within the limits as usually associated with alloys of this class.

TABLE I

PRIOR ART ALLOYS
COMPOSITION IN WEIGHT PERCENT wt/%

| | Alloy C-276 | | Alloy G | | Alloy 625 | | Alloy 690 | |
|---|---|---|---|---|---|---|---|---|
| | Range | Typical | Range | Typical | Range | Typical | Range | Typical |
| Cr | 14–26 | 15.5 | 18–25 | 22 | 20–24 | 21.5 | 27.9–30.8 | 30 |
| Mo | 3–18 | 16 | 2–12 | 6.5 | 7–11 | 9 | — | — |
| W | 0–5 | 4 | 0–5 | 1 max | 0–8 | — | — | — |
| Cu | — | — | 0–2.5 | 2 | — | — | — | — |
| Cb/Ta | — | — | .1–5 | 2 | 3–4.5 | 3.5 | — | — |
| Fe | 0–30 | 5 | Bal-over 15 | 20 | 20 max | 5 | 8.7–12.4 | 10.5 |
| Ti | — | — | — | — | Al + Ti .4 max | .2 | .16–.54 | .3 |
| C | 0.1 max | .02 max | 0.25 max | .05 max | .1 max | .05 | .01–.07 | .045 |
| Ni | 40–65 | 57 | 35–50 | — | 55–62 | 62 | about 60 | 59 |

TABLE II

ALLOY OF THIS INVENTION
IN PERCENT BY WEIGHT, wt/%

| | Broad | Preferred | Alloy G-30 |
|---|---|---|---|
| Chromium | 26–35 | 27–32 | about 30 |
| Molybdenum | 2–6 | 3–5 | about 4 |
| Tungsten | 1–4 | 1.5–3 | about 2 |
| Cb + Ta | .3 to 2.0 | .5–1.5 | about 1 |
| Copper | 1–3 | 1–2 | about 1.5 |
| Iron | 10–18 | 12–16 | about 14 |
| Mn | up to 1.5 | up to 1 | about .6 |
| Si | up to 1.0 | up to .7 | about .1 |
| C | .10 max | .07 max | about .04 |
| Al | up to .8 | up to .5 | about .25 |
| Ti | up to .5 | up to .3 | about .2 |
| Ni plus impurities | Bal | Bal | about 46 |

TABLE III

EFFECT OF CHROMIUM IN
CORROSION RESISTANCE TO PHOSPHORIC ACID

| Alloys | Corrosion Rates (Mpy) In 46%/—$P_2O_5$ at 116° C. |
|---|---|
| C-276 (16Cr) | 44 |
| G (22Cr) | 16 |
| 625 (22Cr) | 18 |
| 690 (30Cr) | 5 |

TABLE III-continued

EFFECT OF CHROMIUM IN
CORROSION RESISTANCE TO PHOSPHORIC ACID

| Alloys | Corrosion Rates (Mpy) In 46%/—$P_2O_5$ at 116° C. |
|---|---|
| G-30 (30Cr) | 4 |

Increasing chromium content provides better resistance to phosphoric acid.

TABLE IV

EFFECT OF MOLYBDENUM IN
THE CORROSION RATE TO PHOSPHORIC ACID

| Alloys | Corrosion Rates (Mpy) In 52%/—$P_2O_5$ at 149° C. |
|---|---|
| 690 (30Cr—0-Mo) | 447 |
| G-30A (30Cr—4Mo) | 61 |

As the concentration and temperature of $P_2O_5$ increase, Mo alloying with is needed.

TABLE V

EFFECT OF TUNGSTEN IN
THE CORROSION RATE TO PHOSPHORIC ACID

| Alloys | Corrosion Rates (Mpy) In 54%/—$P_2O_5$ at 149° C. |
|---|---|
| G-30A (30Cr—4Mo—0W) | 165 |
| G-30 (30Cr—4Mo—2W) | 38 |

Tungsten addition provides improved resistance to super phosphoric acid.

TABLE VI

CORROSION RESISTANCE IN SULFURIC ACID

| Alloys | Reducing 10% $H_2SO_4$ | Oxidizing $H_2SO_4$ ASTM G-28 |
|---|---|---|
| G (22Cr—6Mo—0W) | 25 | 22 |
| G-30 (30Cr—4Mo—2W) | 12 | 8 |

Excellent resistance to sulfuric acid media.

What is claimed is:

1. An alloy characterized by a high degree of corrosion resistance to phosphoric acid consisting essentially of, in weight percent, chromium 26 to 35, molybdenum 3 to 6, tungsten 1 to 4, Cb plus Ta 0.3 to 2.0, copper 1 to 3, iron 10–18, manganese up to 1.5, silicon up to 1.0, carbon 0.10 maximum, aluminum up to 0.8, titanium up to 0.5 and the balance nickel plus incidental impurities wherein the ratio of molybdenum to tungsten is between 1.5 to 1 and 4 to 1 to provide said high degree of corrosion resistance.

2. The alloy of claim 1 containing chromium 27 to 32, molybdenum 3 to 5, tungsten 1.5 to 3, Cb plus Ta 0.5 to 1.5, copper 1 to 2, iron 12 to 16, manganese up to 1, silicon up to 0.7 carbon 0.07 maximum, aluminum up to 0.5, and titanium up to 0.3.

3. The alloy of claim 1 containing about 30 chromium, about 4 molybdenum, about 2 tungsten, about 1 Cb plus Ta, about 1.5 copper, about 14 iron, about 0.6 manganese, about 0.1 silicon, about 0.04 carbon, about 0.25 aluminum, and about 0.2 titanium.

* * * * *